United States Patent [19]

Urich

[11] 4,338,905

[45] Jul. 13, 1982

[54] METHOD AND APPARATUS FOR PRODUCING AND SUPPLYING ATOMIZED FUEL TO AN INTERNAL COMBUSTION ENGINE

[76] Inventor: Carl L. Urich, 7293 S. Sherman St., Littleton, Colo. 80122

[21] Appl. No.: 145,605

[22] Filed: May 1, 1980

[51] Int. Cl.[3] ..... F02M 21/02; F02M 17/26

[52] U.S. Cl. ..... 123/525; 123/536; 123/575; 123/518

[58] Field of Search ..... 123/525, 536, 538, 575, 123/577, 518

[56] References Cited

U.S. PATENT DOCUMENTS 2,150,764 3/1939 Farineau ..... 123/575
2,315,881 4/1943 Thomas ..... 123/575
2,796,852 6/1957 Schumacher ..... 123/575

*Primary Examiner*—Wendell E. Burns

[57] ABSTRACT

A method and apparatus for efficiently atomizing fuel for supplemental supply to an internal combustion engine are described wherein the atomized fuel is supplied to the engine in addition to the conventionally carburetted fuel. A portion of the fuel being supplied to a carburetor in a conventional manner is diverted to the system according to the invention and is supplied thereto in a metered fashion. A fuel vapor is produced and is supplied to the engine downstream of the carburetor, as required by the engine; this requirement being indicated by engine vacuum. Vaporization is accomplished in the described embodiment by heat and ultrasonic nebulization.

14 Claims, 7 Drawing Figures

METHOD AND APPARATUS FOR PRODUCING AND SUPPLYING ATOMIZED FUEL TO AN INTERNAL COMBUSTION ENGINE

BACKGROUND OF THE INVENTION

This invention relates to fuel supply apparatus for an internal combustion engine and, in particular, to method and apparatus for supplying vaporized fuel in addition to conventionally carburetted fuel for promoting engine efficiency.

It is now well known that conventionally produced internal combustion engines are inefficient in the sense that in the exhaust therefrom there is present unburned or partially burned fuel. In response to this situation, and often mandated by government regulation, devices for eliminating these unburned or partially burned particles from automotive exhaust have been introduced. This generally involves the use of filtering devices which, at best, are partially effective and often cause a significant reduction in the performance of the engines to which they are attached. Generally, in order to overcome the deficiencies of the filtering devices, it has been necessary to adjust the engines in question to operate on a "leaner" fuel-air mixture. Again, this is only a partial solution and has resulted in an overall decrease in the efficiency of operation of internal combustion engines.

It is known that atomization of liquid fuel beyond the amount realized by utilization of a standard automotive carburetor improves the efficiency and operation of the leaner-burning engines which must be used to reduce the amount of pollutants emitted therefrom. Improved atomization enables leaner fuel mixtures to be utilized because the mixture, improved by atomization, promotes more complete combustion of the fuel-air mixture thereby promoting easier starting of the engine, leaner and shorter duration of choke settings and more satisfactory operation of cold engines. These desirable results can be achieved even in the presence of the leaner mixture settings which, as mentioned, must now be used.

While, as pointed out hereinabove, it is desirable to as completely as possible atomize the fuel in the fuel-air mixture, conventional carburetor-type fuel supply installations which are now generally present do not accomplish this result. In the conventional carburetor, fuel is atomized by a venturi-type negative pressure. The fuel particles resulting from any atomization taking place in the conventional carburetor are relatively large in diameter so that they may remain and attach themselves to the inner walls of an intake passage. This, of course, alters the prescribed fuel-air ratio. This problem would not be present if the fuel particle size were reduced, as by atomization. In any event, carburetor-equipped internal combustion engines, as are presently available, are not equipped to provide for such atomization, and they cannot be so equipped without expensive and relatively complex modification.

In view of the foregoing, it is an object of this invention to provide means and method for supplementing the carburetted fuel supply in a conventional internal combustion engine with an atomized fuel supply in order to increase the efficiency of operation of the engine.

Another object of this invention is to provide means and method for efficiently providing a vaporized fuel supply on demand to an internal combustion engine during operation of the engine.

Still another object of this invention is to provide a supplementary fuel supply for the conventional carburetted fuel supply in an internal combustion engine, but one which does not increase the magnitude of the total fuel consumption of the engine.

A further object of this invention is to provide means and method by which the operating efficiency of an internal combustion engine can be increased while still reducing the air pollutants it emits.

SUMMARY OF THE INVENTION

The foregoing and other objects are accomplished by provision of a fuel vaporization system which receives fuel, as needed, from the engine fuel supply and supplies vaporized fuel to the engine, on demand from the engine, downstream of the carburetor and perhaps at the combustion chambers. The outlet of the fuel vapor generating system is, for example, connected in the positive crank case ventilation system (PCV) line from the valve cover to the carburetor so that engine vacuum will draw the vaporized fuel into the mixture stream to the combustion chambers. Fuel is supplied to the vapor generating system on a metered basis, as needed, to replace vapor drawn from the vapor generator so that the total fuel demand does not exceed that which would be present in the absence of the use of this invention. The fuel supplied to the vapor generating system is vaporized therein through the use of the technique of ultrasonic nebulization, and this may be combined with the use of heat. The amount of fuel in the vapor generating system at any given time is maintained at a substantially constant level and is in balance with the amount of vapor drawn from the vapor generator on demand from the engine.

BRIEF DESCRIPTION OF THE DRAWINGS

The principles of the invention will be more readily understood by reference to the description of a preferred embodiment thereof given hereinbelow in conjunction with the drawings which are briefly described as follows.

DESCRIPTION OF A PREFERRED EMBODIMENT

Figure 1:
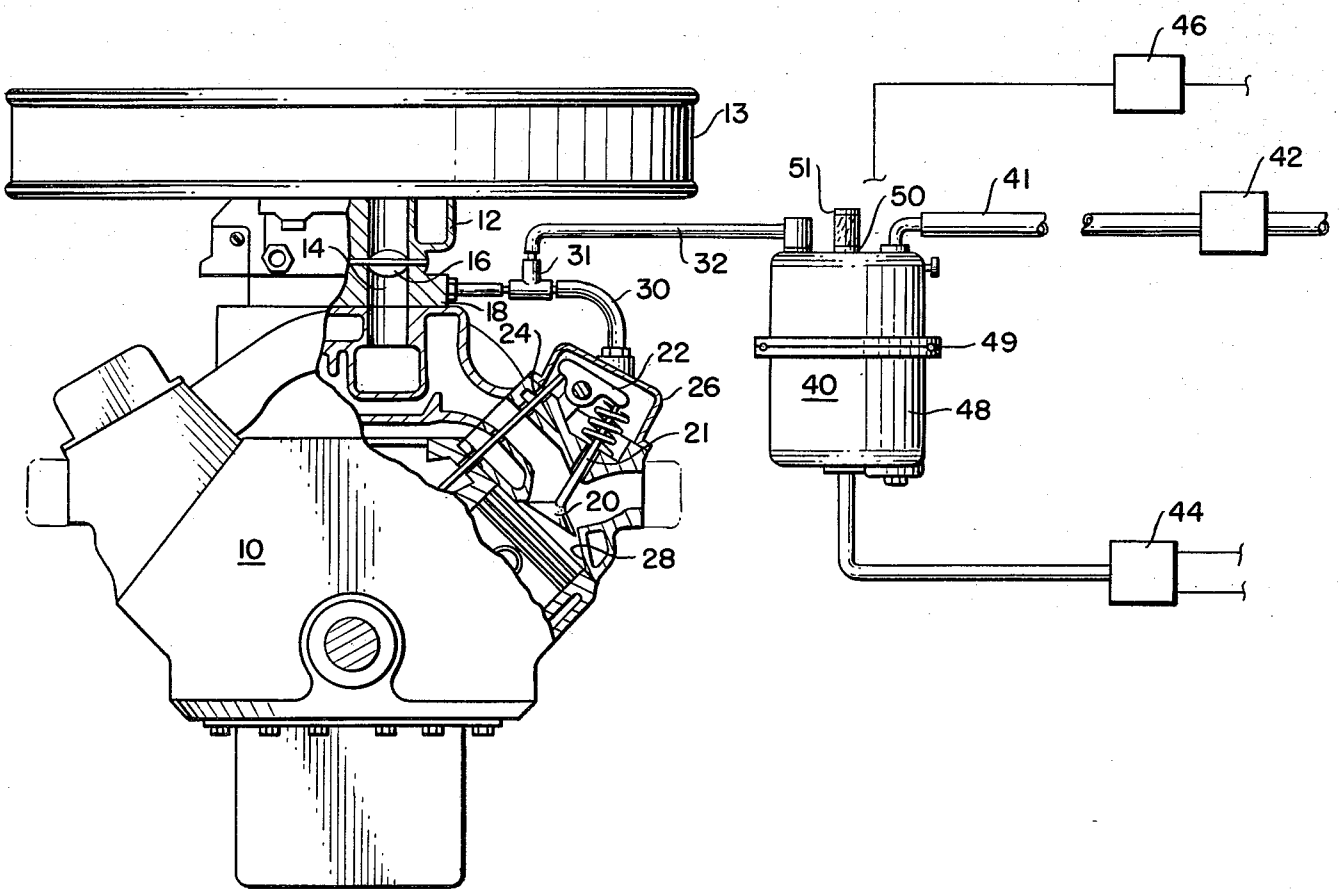
FIG. 1 is a diagrammatic illustration of the connected relationship of a preferred embodiment constructed according to the invention with a conventional internal combustion engine.

FIG. 1 in diagrammatic form illustrates the structural and functional relationship between the system according to the invention and a conventional internal combustion engine of the type which might be used in an automobile.

In FIG. 1, engine 10 in a conventional manner is equipped with a carburetor 12 having an air cleaner 13. An inlet passage or throat 14 along with a valve 16 provide an air passage from air cleaner 13 into the intake manifold of the engine, gasoline being mixed with the air in the carburetor in the usual manner to provide a combustible fuel-air mixture. A passageway 18 through the carburetor wall communicates with the throat 14 to define a primary vacuum inlet which serves as a source of vacuum or reduced pressure for various engine functions or for the operation of accessories as needed.

In the cutaway portion of the drawing, certain internal parts of the engine are illustrated. One of a series of cylinders 28 is shown, each cylinder having an exhaust valve 20 and a valve stem 21 connected at its upper end to one side of a rocker arm 22, the other side of which is connected to push rod 24. These parts, under the control of the engine camshaft operate to open exhaust valve 20 at the appropriate point in the engine operating cycle. The valves and operating assemblies for the bank of cylinders on the side of the engine where the cutaway portion is found are covered by a valve cover 26.

In more recent forms of the internal combustion engine, exhaust gases which may accumulate in valve cover 26 are communicated to the carburetor for further combustion by a positive crankcase ventilation system. This system usually includes hoses or other conduits connecting the valve chambers to the carburetor via one-way valves. In this case, PCV conduit 30 is connected to primary vacuum inlet 18; in the ordinary situation, this primary vacuum inlet would serve to draw the exhaust gases from the valve chambers into the carburetor. However, in the illustrated embodiment, a T connector 31 is interposed in conduit 30 for communicating fluid from another source to be described to the same point in the carburetor.

An additional conduit 32 connects the upward branch of T connector 31 to vapor generation system 40. Vapor emitted from the latter system is by this means introduced into the engine for admixture with the fuel-air mixture communicated from carburetor 12. Vapor generator system 40 receives fuel to be vaporized from an electric auxiliary fuel pump 42 via fuel conduit line 41. Conduit 41 is branched from the main fuel supply line (not shown). As will be discussed in greater detail hereinbelow, atomization of the fuel is principally carried out by the use of ultrasonic energy from a transducer which is powered by a frequency generator 44 operating at the appropriate frequency. The amount of fuel and vapor in vapor generation system 40 at any one time is controlled in the manner to be described hereinbelow by a fuel level sensor system 46 having sensors connected at appropriate points in the vapor generation system.

Vapor generator 40 is contained in a tank-like container 48 of two-piece construction; the adjoining surfaces of the two pieces having interposed therebetween an appropriate gasket sealer 49. An air inlet 50 to the vapor generation system is provided, and it is equipped with an air filter 51. The air inlet may be electrically operated in a manner to be described.

Figure 2:
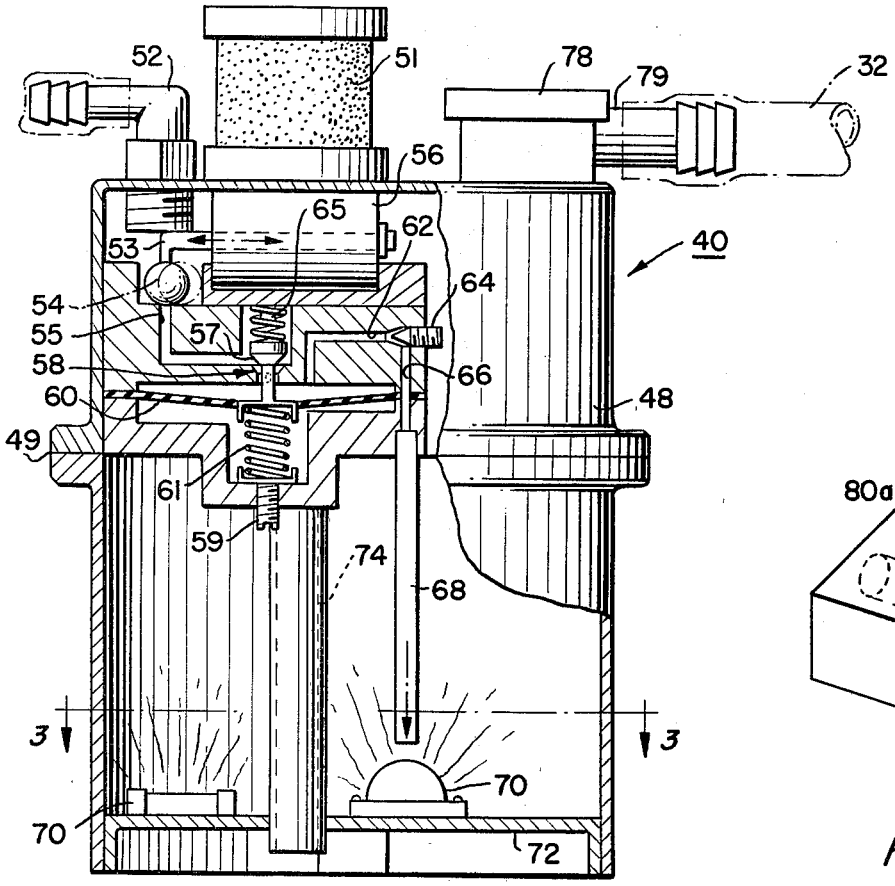
FIG. 2 is a partial cross section of a preferred embodiment of a vapor generator constructed in accordance with the principles of the invention.

FIG. 2 is a partial cutaway view of vapor generation system 40 and illustrates in detail the construction operation of a preferred embodiment of the vapor generator.

In this embodiment, fuel supplied from fuel pump 42 is communicated to vapor generator 40 and enters the latter via an elbow-shaped inlet fitting 52. It should be noted that it is preferable that the fuel proceed to vapor generator 40 through a flow indicator (not shown). The use of such a flow indicator, the construction of which is well known in the art, will provide an indication that the proper amount of fuel is being metered to the vapor generator. Further, the indicator can as well provide an indication as to whether the unit is properly pumping during engine operation. Further, it is contemplated that the flow indicator in a conventional manner can operate the following valve arrangement to control and flow into vapor generator 40.

A ball valve 54 is operated by solenoid 56 via arm 53. Actuation of the solenoid, e.g. from the above fuel flow indicator, allows fuel from input fitting 52 to proceed into passage 55 and to proceed into a pressure regulating valve generally indicated at 58. Pressure regulator 58 in this embodiment is designed to maintain a fuel pressure of approximately 1.5 pounds per square inch. The pressure existing around the upper surface of diaphragm 60 is established by adjustment of screw 59 which, in turn, adjusts the compression of coil spring 61 against diaphragm 60 and valve stem 57. A counter force is supplied by compressed coil spring 65 so that the proper fuel supply pressure to the system is thereby established. Fuel from pressure regulator 58 proceeds through passage 62 to a metering valve formed by adjustment screw 64. Adjustment screw 64 can be positioned to cause the fuel to proceed for vaporization at the particular drop rate which will establish the required vapor level in the system. The drops will travel through passage 66 into duct 68 through which they fall to impinge upon electrical resistance unit 70.

Figure 3:
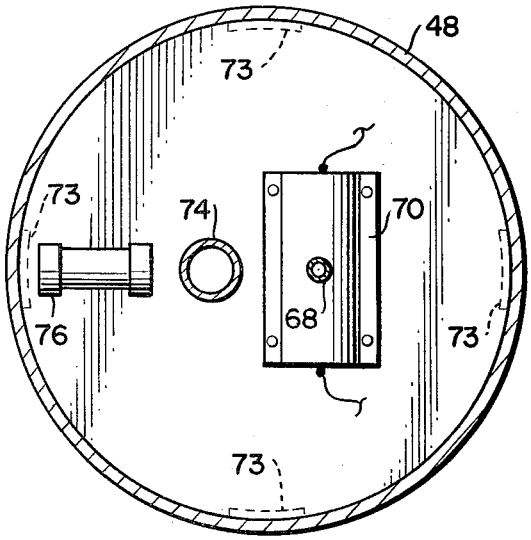
FIG. 3 is a section view taken along the line 3—3 of the FIG. 2 embodiment.

The electrical resistance unit 70, which functions at all times when the engine is operating, rests on an aluminum base 72 which forms the floor of the vapor generator housing 48. As best shown in FIG. 3, floor 72 includes a series of perforations 73 therearound to permit air to be drawn into the vapor generator chamber. That displacement air is supplied via duct 74 from air inlet 50.

The initial vaporization of the fuel droplets occurs through the utilization of heat from resistance unit 70. However, in order to maintain nebulization and a substantially even vapor density throughout the chamber of vapor generator 40, an ultrasonic transducer 76 is provided. This transducer may be a conventional piezoelectric element actuated as will be described hereinbelow from an oscillator or frequency generator which generates energy at an ultrasound frequency in the conventional manner.

As described hereinabove, vapor from vapor generator 40 is drawn from it by engine vacuum which bears a direct proportional relationship to the amount of fuel required for proper operation of engine 10. The vapor proceeds outwardly through a check valve 78 having, for example, outlets 79, one of which is supplied for each cylinder of the engine. The vapor proceeds through conduit or conduits 32 to T connector 31 as described hereinabove.

Figure 4:
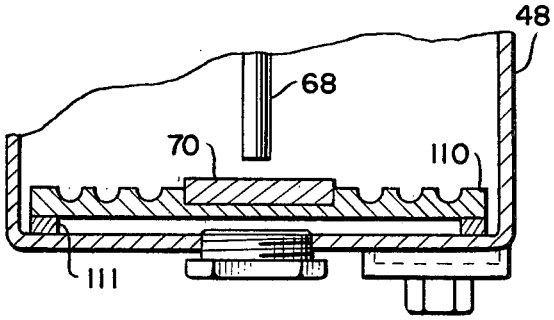
FIG. 4 is a partial cross-sectional view of an alternative form of the FIG. 3 embodiment.

FIG. 4 is an alternative arrangement for the base portion of vapor generator 40. In this embodiment, container or housing wall 48 extends continuously to form the floor of the vapor generator. Insulating spacers 111 support thereon a resistance plate 110 which is electrically actuated to provide vaporization heat. In this arrangement, transducer 70 and fuel duct 68 are more centrally positioned. The transducer is mounted in a depression in plate 110.

Figure 5:
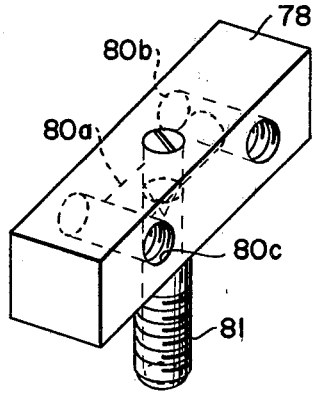
FIG. 5 is a perspective view of a preferred embodiment of a check valve to be used at the vapor outlet of the FIG. 2 embodiment.

FIG. 5 is a perspective view of an exemplary embodiment of check valve 78. This valve is a simple one-way valve which prevents engine pressure from flowing back in to vapor generator 40. The vapor proceeds into the valve 78 through input fitting 81 and is communicated to output passages 80*b* and 80*c* via a communicating passage 80*a*. In this embodiment, four output orifices are shown for supplying vapor directly to the cylinders of a four-cylinder engine.

Figure 6:
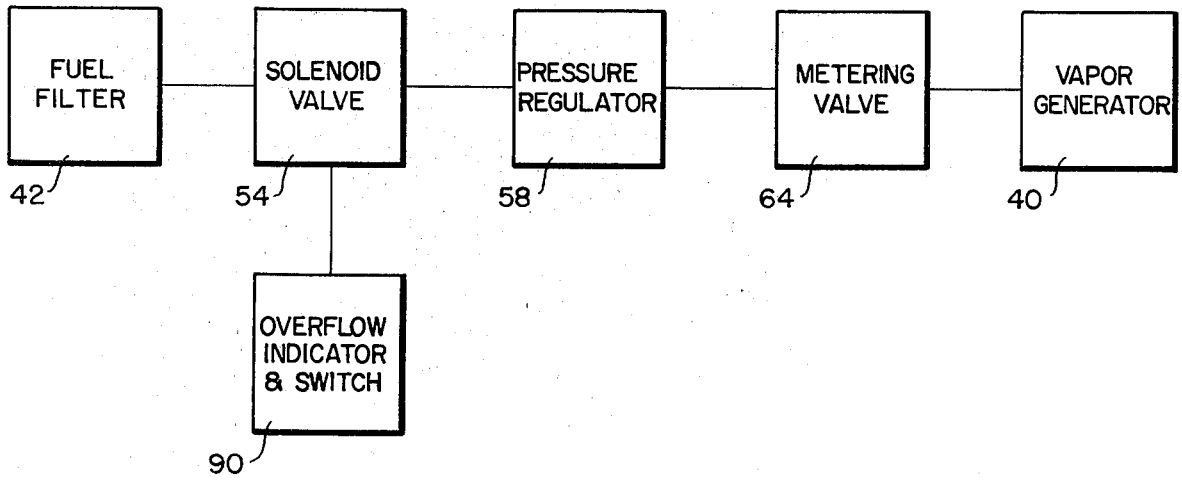
FIG. 6 is a block diagram illustrating the stream of fuel supply to the invention.

FIG. 6 is a block diagram providing a schematic illustration of the fuel flow system for the vapor generation system of this invention. As is clear, fuel from an auxiliary fuel supply pump 42 is supplied to the vaporization system and entry thereof into the system is controlled by solenoid operated ball valve 54. The operation of the solenoid is controlled by flow indicator 90. The fuel thus supplied proceeds to pressure regulator 58 to metering valve 64 and from there to vapor generator 40.

Figure 7:
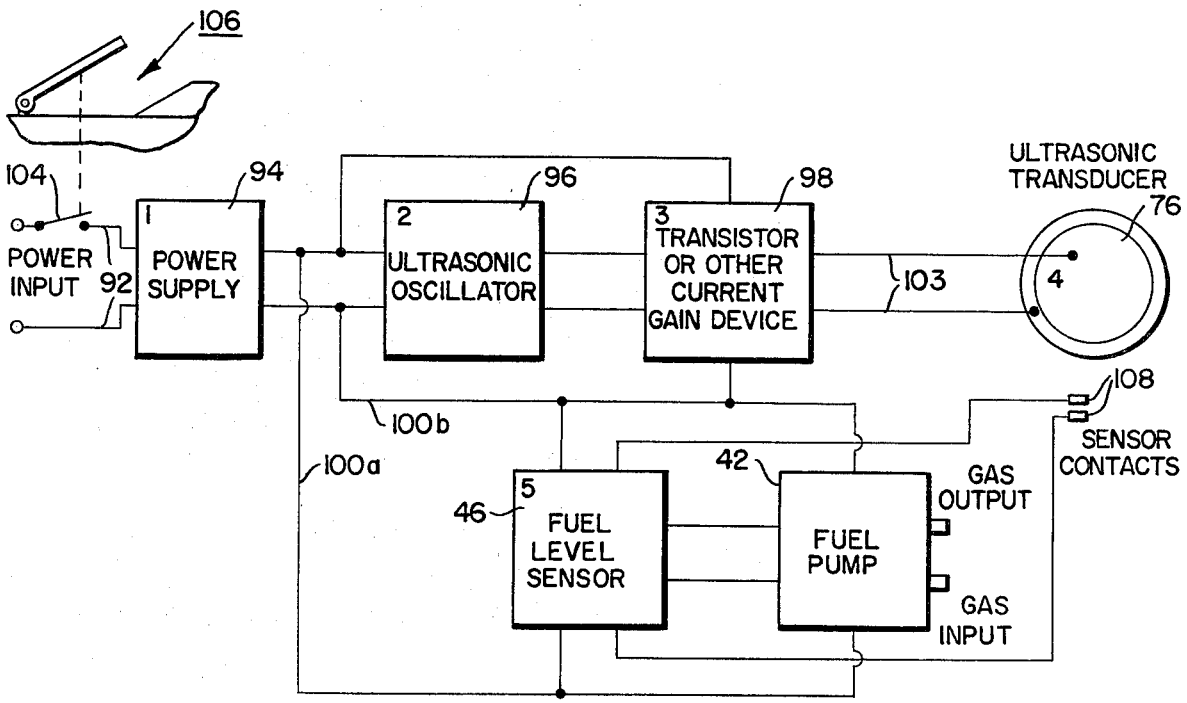
FIG. 7 is a schematic diagram of the electronic control system for the preferred embodiment of the invention.

FIG. 7 schematically illustrates the electronic control arrangement in accordance with the invention. The various individual components are not described in detail herein in view of their conventional nature.

Power input to the system is supplied by a pair of leads 92 from, for example, the vehicle battery. Power supply 94 processes the battery voltage to a desired voltage and current level for operation of the remainder of the system. From power supply 94, power is supplied to an ultrasonic oscillator 96, as well as current amplifier 98. In addition, leads 100*a* and 100*b* from power supply 94 energize fuel level sensor 46 and an auxiliary electric fuel pump 42. Switch 104 selectively applies power from the main source to power supply 64 under the control of, in this example, the automobile throttle mechanism generally indicated at 106.

Ultrasonic oscillator 96 generates an electrical signal at an ultrasound frequency which is amplified in amplifier 98 and from there is supplied via leads 103 to the aforementioned ultrasound transducer 76.

In order to properly control the amount of fuel being supplied to vapor generator 40, the vapor level present within the chamber of vapor generator 40 can be electrically monitored in a known fashion. That is, for example, a capacitance-type sensor may be provided in the form of sensor contacts 108, and these can be positioned to respond to a given vapor level in the chamber of vapor generator 40. Should the vapor level reach a given value, fuel level sensor in response to contacts 108 will operate an electric fuel pump 42 which is placed in line 41. Thus, full control is achieved over fuel flow to the vapor generator so that no more fuel is communicated thereto than vapor is emitted therefrom. It will be remembered that the amount of vapor emitted from vapor generator 40 is controlled by engine demand, so that fuel flow to vapor generator 40 is a function of engine demand. In addition, as discussed above, fuel flow is controlled by overflow indicator and switch 90 which operates the ball valve 54 to prevent a fuel overflow and waste condition. It is important to note that this electronic control system is operated by the engine throttle. It can be readily mechanically arranged to be turned off as soon as the throttle assumes an idle position. By this means, it is not necessary to provide for further adjustments to the carburetor air flow valves.

The embodiments of the invention described hereinabove are considered to be only exemplary of the principles of the invention. It is contemplated that the described preferred embodiments can be modified or changed within the skill of the art without departing from the scope of the invention as defined by the appended claims.

I claim:

1. Apparatus for producing vaporized fuel and for supplying the vaporized fuel to combustion areas of a carburetor-equipped internal combustion engine, wherein said carburetor is supplied with fluid fuel from a fuel source, comprising:

branch means for additionally supplying said fluid fuel to said apparatus, a container including means defining a vapor chamber therein, inlet valve means for controlling fuel flow from said branch means into said container, pressure regulator means in fluid communication with said inlet valve means for maintaining the pressure of fuel flow in said container at a predetermined value, metering means in fluid communication with said pressure regulator and for supplying fuel droplets to said vapor chamber at a selected rate, vapor producing means in said vapor chamber for converting said fuel droplets to a vapor of atomized particles, and outlet valve means in fluid communication with said vapor chamber for supplying the vapor therein to said internal combustion engine.

2. The apparatus defined in claim 1 wherein said outlet valve means is in fluid communication with said internal combustion engine downstream of the carburetor, and wherein vacuum produced through the operation of said internal combustion engine draws said vapor through said outlet valve means to said internal combustion engine.

3. The apparatus defined in claim 1 wherein said vapor producing means comprises a heating means.

4. The apparatus defined in claim 1 wherein said vapor producing means comprises a means for producing ultrasonic energy.

5. The apparatus defined in claim 1 wherein said vapor producing means comprises heating means and means for producing ultrasonic energy.

6. The apparatus defined in claim 1 further comprising flow indicating and switch means for operating said inlet valve means when fuel flow in said branch means is excessive.

7. The apparatus defined in claim 6 wherein said inlet valve means comprises a solenoid actuated ball valve and wherein said solenoid is controlled by said flow indicating and switch means.

8. The apparatus defined in claim 1 further comprising means in said branch line for controlling the flow of fuel therethrough and vapor sensor means in said vapor chamber for controlling said means in said branch line for halting the flow of fluid therethrough when a predetermined vapor content in said chamber is sensed.

9. The apparatus defined in claim 8 wherein said means in said branch line for controlling the flow of fuel therethrough is an auxiliary fuel pump which is controlled by said vapor sensor means.

10. The apparatus defined in claim 9 further comprising throttle switch means for activating and deactivating said auxiliary fuel pump at predetermined levels of operation of said internal combustion engine.

11. A method of supplying fuel to a carburetor-equipped internal combustion engine, comprising the steps of:

supplying fuel from a source to said carburetor, supplying fuel from said source to a vapor generating means via a branch line, producing in said vapor generating means a vapor of atomized particles from the fuel supplied via said branch line and communicating said vapor to said engine at a point therein downstream of the carburetor.

12. The method defined in claim 11 wherein said vapor is drawn from said vapor generating means by the engine vacuum.

13. The method defined in claim 11 wherein said communicating step comprises communicating said vapor to each of the cylinders in said internal combustion engine.

14. The method defined in claim 11 comprising the additional step of deactivating said vapor generating means when said internal combustion engine is operating at idle.

* * * * *